US011375803B2

(12) United States Patent
Berhault

(10) Patent No.: US 11,375,803 B2
(45) Date of Patent: Jul. 5, 2022

(54) MASCARA APPLICATOR

(71) Applicant: L'OREAL, Paris (FR)

(72) Inventor: Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 225 days.

(21) Appl. No.: 16/346,926

(22) PCT Filed: Nov. 27, 2017

(86) PCT No.: PCT/EP2017/080540
§ 371 (c)(1),
(2) Date: May 2, 2019

(87) PCT Pub. No.: WO2018/099865
PCT Pub. Date: Jun. 7, 2018

(65) Prior Publication Data

US 2020/0054120 A1 Feb. 20, 2020

(30) Foreign Application Priority Data

Dec. 2, 2016 (FR) ..... 1661850

(51) Int. Cl.
*A46B 9/02* (2006.01)
*A45D 40/26* (2006.01)

(52) U.S. Cl.
CPC ..... *A46B 9/021* (2013.01); *A45D 40/265* (2013.01); *A46B 2200/1053* (2013.01)

(58) Field of Classification Search
CPC .. A45D 34/042; A45D 34/043; A45D 34/045; A45D 34/046; A45D 40/262;
(Continued)

(56) References Cited

U.S. PATENT DOCUMENTS 4,422,986 A * 12/1983 Cole ..... A46B 3/005 15/187
4,964,429 A * 10/1990 Cole ..... A45D 40/265 132/216

(Continued)

FOREIGN PATENT DOCUMENTS

EP 3 010 367 4/2016
FR 2 922 420 A1 4/2009

(Continued)

OTHER PUBLICATIONS

International Search Report dated Feb. 1, 2018 in PCT/EP2017/080540 filed on Nov. 27, 2017.

(Continued)

*Primary Examiner* — Rachel R Steitz
*Assistant Examiner* — Karim Asqiriba
(74) *Attorney, Agent, or Firm* — Oblon, McClelland, Maier & Neustadt, L.L.P.

(57) ABSTRACT

The present invention relates to a brush (8) for applying a cosmetic product to the eyelashes and/or eyebrows, comprising: a core (10) of plastic material, having a longitudinal axis, spikes (11, 13) carried by the core, including at least a first row of spikes extending longitudinally, this row comprising a series of at least four consecutive spikes positioned at respective abscissae $x_1$ to $x_4$ along the longitudinal axis, with $d_1=x_2-x_1$, $d_2=X_3-x_2$, $d_3=x_4-X_3$ and $d_1$, $d_2$ and $d_3$ being different in pairs.

31 Claims, 3 Drawing Sheets

Figure 1:
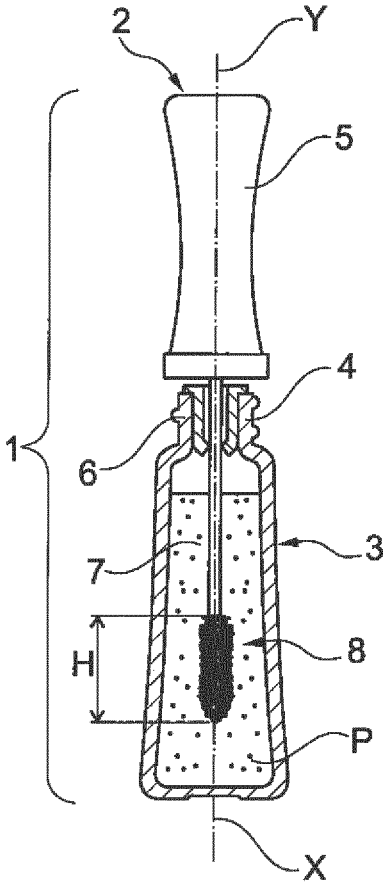

(58) Field of Classification Search
CPC .. A45D 40/264; A45D 40/265; A45D 40/267; A46B 9/021; A46B 9/025; A46B 2200/1053; A46B 2200/1046; A46B 2200/106; A46B 9/02
USPC ..... 132/218, 313, 317, 901; 15/207.2; 401/129
See application file for complete search history.

(56) References Cited

U.S. PATENT DOCUMENTS 5,396,678 A * 3/1995 Bredall ..... A46B 9/04 15/167.1
5,638,568 A * 6/1997 Dumler ..... A46B 3/18 15/167.1
D587,459 S * 3/2009 Chiang ..... A46B 9/021 D4/128
7,789,094 B2 * 9/2010 Gueret ..... A46B 9/021 132/218
7,992,577 B2 * 8/2011 De Brouwer ..... A45D 40/262 132/218
D677,904 S * 3/2013 Hammer ..... A46B 3/18 D4/128
10,188,194 B2 * 1/2019 Kim ..... A46B 9/021
2001/0046406 A1 * 11/2001 Schrepf ..... A46B 3/18 401/126
2010/0300475 A1 12/2010 Gueret
2011/0067725 A1 * 3/2011 Manici ..... A45D 40/265 132/218
2011/0154597 A1 * 6/2011 Manici ..... A46B 3/18 15/207.2
2017/0238678 A1 * 8/2017 Manici ..... A46B 9/026
2017/0354239 A1 12/2017 Manici et al.

FOREIGN PATENT DOCUMENTS

FR 3004906 A1 * 10/2014 ..... A46B 9/021
FR 3 030 203 A1 6/2016
WO WO 2006/090343 A1 8/2006
WO WO 2014/195911 A1 12/2014

OTHER PUBLICATIONS

French Preliminary Search Report dated Aug. 9, 2017 in FR 1661850 filed on Dec. 2, 2016.

* cited by examiner

MASCARA APPLICATOR

The present invention relates to applicators for applying a cosmetic, makeup or care product to the eyelashes and/or eyebrows, in particular mascara, and to packaging and application devices having a container containing the product to be applied and the applicator.

The container is conventionally provided with a wiping member which wipes the stem of the applicator as it is withdrawn from the container. The behavior of the applicator member on passing through the wiping member depends on numerous factors, such as the shape and nature of the lip of the wiping member, the joining part between the stem and the applicator member, and the arrangement of the application elements on the applicator member.

A compromise has to be found with regard to the quantity of product which is left on the applicator member for application of makeup. Excessive wiping of the applicator member causes the latter to be insufficiently loaded and obliges the user to frequently dip the applicator back into the container. Insufficient wiping leaves an excess of product that is difficult to manage and could result in clumps of product on poorly separated eyelashes.

Application FR 3 030 203 discloses a brush comprising series of groups of two spikes within axially offset longitudinal rows.

Application WO 2014/195911 describes a brush comprising longitudinal rows of spikes and teeth of flattened cross section between the rows.

Application FR 2 922 420 discloses a brush comprising rows of teeth molded from different materials.

There is a need to further improve applicators for applying a product to the eyelashes and/or eyebrows, in order to improve the performance thereof, and more particularly to promote the creation on the applicator member of zones laden with product, which allow easy application of makeup and rapid and abundant loading of the eyelashes and/or eyebrows, to give them volume initially, while retaining a high capacity to separate the eyelashes and/or eyebrows in a second makeup step.

The invention aims to meet this objective and, according to one of its aspects, relates to a brush for applying a cosmetic product to the eyelashes and/or eyebrows, comprising:

- a core of plastic material, having a longitudinal axis,
- spikes carried by the core, including at least a first row of spikes extending longitudinally, this row comprising a series of at least four consecutive spikes positioned at respective abscissae $x_1$ to $x_4$ along the longitudinal axis of the core, with $d_1=x_2-x_1$, $d_2=x_3-x_2$, $d_3=x_4-x_3$ and $d_1$, $d_2$ and $d_3$ being different in pairs. The spike of abscissa $x_1$ is not necessarily the first spike of the row starting from the proximal end of the brush.

The invention makes it possible to obtain, owing to the positioning of the spikes on the brush, zones that are unequally wiped when the applicator passes through the wiping member, providing, for application of makeup, a surplus of product in certain zones and also zones that are more wiped.

The surplus of product allows the eyelashes and/or eyebrows to be loaded with a large and satisfactory amount of product from the first application. The zones that are more wiped facilitate the combing and the separation of the eyelashes.

The height and shape of the spikes can in particular be varied during the manufacture of the applicator member in order to adjust the level to which the applicator is loaded with product after wiping.

The expression "longitudinal axis of the core" denotes the line connecting all of the centers of mass of the cross sections of the core. The longitudinal axis may be a central axis, or even an axis of symmetry for the core, notably when the core has a circular cross section or the overall shape of a regular polygon. The longitudinal axis of the core may be rectilinear or curved and may be contained in a plane, which may be a plane of symmetry for some, or even for all, of the cross sections of the core. Preferably, the longitudinal axis of the core is rectilinear. In a variant, it is curved.

The term "spike" denotes an individualizable projecting element intended to come into engagement with the eyelashes and/or eyebrows. The spikes may be made from the same material as the core or from a different material.

According to another of its aspects, the invention also relates to a packaging and application device, comprising:

- a container containing the product to be applied,
- a brush according to the invention, as defined above.

According to another of its aspects, which may or may not be combined with the first aspect above, the invention relates to a brush for applying a cosmetic product to the eyelashes and/or eyebrows, comprising:

- a core of plastic material, having a longitudinal axis,
- spikes carried by the core, including at least one row of spikes extending longitudinally, this row comprising a series of spikes, including at least three consecutive spikes of respective abscissae $x_1$ to $x_3$ defining two different distances $d_2=x_3-x_2$ and $d_1=x_2-x_1$, these spikes having different cross sections at their base.

Positioning of the Spikes on the Core

The irregular distribution, and in particular the irregular spacing between the at least four consecutive spikes of a row of spikes of the brush according to the invention, makes it possible to obtain a good compromise between the possibility of accumulating product between the spikes and thus creating reserves of product, and good performance levels in terms of separation of the eyelashes.

The spikes advantageously extend from the core and all around this core. The number of longitudinal rows may be an even number. There may be at least eight longitudinal rows of spikes in total, notably twelve rows.

The longitudinal rows are preferably rectilinear. The axis of each longitudinal row is preferably parallel to the longitudinal axis of the core.

The spikes in two adjacent longitudinal rows are preferably not joined at their base.

At least one spike may extend from the core along an elongation axis perpendicular to the surface of the core, at the point at which the spike is attached to the core. Preferably, the spikes each extend from the core along an elongation axis perpendicular to the surface of the core at the point at which the spikes are attached to the core. This elongation axis may be radial.

The surface of the core to which the spikes are attached may or may not be a surface of revolution.

In a variant, the elongation axis of the spikes forms an angle other than 90° with the surface of the core at the point at which the spikes are attached to the core.

The aforementioned series of spikes may comprise at least a fifth spike of abscissa $x_5$, with $d_4=x_5-x_4$ and $d_4$ being different from $d_1$, $d_2$ and $d_3$. Preferably, $d_4>d_3$. Also preferably, $d_1$, $d_2$ and $d_3$ are not bound by a proportionality relationship. Better still, $d_1$, $d_2$, $d_3$ and $d_4$ are not bound by a proportionality relationship. It is possible to have $d_1<d_2$ and $d_3<d_1$.

The pattern formed by said series of spikes may be repeated at least once along said first row.

The series of spikes may comprise spikes of unequal sizes, in particular of unequal heights and/or of unequal cross sections at their base, preferably at least three spikes of unequal sizes, in particular of unequal heights and/or of unequal cross sections at their base.

The brush may comprise at least one other row of spikes adjacent to the first row, better still at least two other rows, even better still at least three other rows, these rows being angularly consecutive around the longitudinal axis of the core, these angularly consecutive rows comprising respective series of spikes that form patterns which are different in pairs.

The brush may thus comprise a second row of spikes adjacent to the first, this second row comprising successive groups of at least two spikes, better still of at least three spikes.

At least one of the other row(s), better still each of said other rows, comprises a series of at least four consecutive spikes positioned at respective abscissae $x_1$ to $x_{i+3}$ along the longitudinal axis, with $d_1=x_{+1}-x_1$, $d_{i+1}=xi_{+2}-x_{i+1}$, $d_{i+2}=x_{i+3+}-x_{i+2}$ and $d_1$, $d_{i+1}$ and $d_{i+2}$ being different in pairs.

Each of said rows may comprise a series of spikes of unequal sizes.

A pattern formed by the spikes of the first row, and better still by the spikes of the other rows, may be repeated around the longitudinal axis of the core, in particular between three and six times, preferably four times.

The other rows may each comprise at least one spike having the same abscissa, along the longitudinal axis of the core, as a spike of the first row.

The first row may comprise a series of spikes of the same height.

The brush may comprise a second row of spikes having a lower height than the spikes of the first row.

The brush may comprise at least a second row, and better still a third row, having at least three spikes with constant spacing between them.

Each row preferably comprises between eight and twenty spikes.

The core may have a cross section, taken perpendicularly to its longitudinal axis, of any shape, in particular of a circular shape. The largest cross section of the core, namely its diameter in the case in which the cross section of the core has a circular shape, may be between 1.8 mm and 3.4 mm, for example being equal to around 2.4 mm.

In one particular embodiment, the brush comprises a group of four rows, composed of the first row and of other rows, which are repeated angularly over the brush, preferably four times. Each row of this group comprises spikes of unequal sizes and spikes of unequal heights, and all the spikes of each row are not positioned with regular spacing; the number of spikes of one row may in particular be different to that of another row of the same group of rows. Within each row of the same group, it is possible to find at least one spike that has a cross section at its base which is bigger than the consecutive spike when moving toward the distal end of the brush; it is also possible to find at least one spike having a cross section at its base which is smaller than the consecutive spike when moving toward the distal end of the brush. Within each row of the same group, it is possible to find at least one spike that has a greater height than the consecutive spike when moving toward the distal end of the brush; it is also possible to find at least one spike having a smaller height than the consecutive spike when moving toward the distal end of the brush. The cross section of the core may decrease in the direction of the distal end of the core.

Spikes

The height of at least one spike, better still of each spike or of the majority of the spikes, measured from the core to the free end of the spike and perpendicularly to the longitudinal axis of the core, may be between 0.5 mm and 4 mm.

Preferably, the height of the spikes varies when moving along the longitudinal axis of the core.

The spikes advantageously have a semi-conical shape. All the semi-conical spikes may have their flat face oriented in the same circumferential direction, for example clockwise or anticlockwise when the brush is observed along the longitudinal axis of the core from its distal end.

In variants, the spikes have any shape, notably a cylindrical or tapered, frustoconical or pyramidal shape, in particular with a hexagonal base. The spikes may be as described in application EP 3 010 367. When the spikes have a tapered shape, for example conical or semi-conical shape, the degree of convergence in the direction of the apex, that is to say the apex angle of the cone in the case of conical or semi-conical surfaces, may vary between two spikes at least of the row.

All the spikes of the rows may have a similar shape, for example a semi-conical shape. As a variant, several spikes of one and the same row at least have dissimilar shapes, with for example semi-conical spikes and conical spikes.

The cross section of the spikes may have a substantially semi-circular (referred to as half-moon), circular, elliptical or semi-elliptical shape, or may also be, for example, polygonal, in particular hexagonal.

At least one spike may be terminated by a rounded, in particular hemispherical or demi-hemispherical, free end, the radius of curvature of which is for example between 0.08 mm and 0.2 mm.

The spikes can have a thickness of between 0.2 mm and 0.9 mm, better still between 0.3 mm and 0.8 mm. The "thickness of a spike" denotes the greatest transverse dimension of the spike, in cross section, perpendicularly to the elongation axis of the spike and to the longitudinal axis of the core.

The spikes may have a width of between 0.2 mm and 1.2 mm, better still between 0.3 mm and 1 mm. The "width of a spike" denotes the greatest transverse dimension of the spike, in cross section, along the longitudinal axis of the core.

The core and/or the spikes can be molded from one and the same material, or in a variant they can be made from at least two different materials. In variants, the spikes are overmolded on the core, or produced by bi-injection-molding.

The core and/or the spikes are preferably made of a thermoplastic material, in particular of an elastomeric thermoplastic material.

Applicator

The applicator may have a stem that bears the brush at a first end and is fixed to a gripping member at a second end.

The core may be solid, being for example molded with an end piece for fixing to the stem of the applicator. In one variant, the core is hollow.

The brush may be fixed to the stem by snap-fastening, adhesive bonding, welding, crimping, pressing, stapling, force-fitting, fitting in a cold state or fitting in a hot state, for example by mounting an end piece of the brush in a housing in the stem. In a variant, the stem is received in a housing provided in the core.

The stem and the brush may also be molded in one piece, optionally from the same thermoplastic material.

The spikes may be made of a material that is more or less rigid than a material used to produce the stem of the applicator to which the core is attached.

The core may extend along a longitudinal axis which, at at least one point along its length, forms a non-zero angle with the longitudinal axis of the stem to which the core is fixed. The brush may be angled at its attachment to the stem.

The stem may have a first, rigid portion that is extended on the distal side by a second, more flexible portion, for example made of elastomer, that bears the brush.

The visible length of the brush may be between 18 mm and 35 mm, better still between 22 mm and 30 mm, being for example equal to around 27 mm.

The applicator may have between 100 and 600 spikes, for example between 100 and 300 spikes.

The brush may comprise a guard ring adjacent to the stem, in particular formed of radial spikes that are joined at their base to a collar. These spikes may have the same height and be regularly spaced. The guard ring may comprise between ten and twenty spikes.

The external diameter of the guard ring is preferably smaller than the largest diameter of the brush. The guard ring may reduce the risk of the piston effect occurring on passing through the wiping member and reduce the risk of accumulation of dirt on the brush.

The envelope surface of the brush, defined by the free ends of the spikes, may have a maximum diameter away from the proximal and distal ends of the portion of the core bearing the spikes. In particular, the envelope surface may have a smaller diameter at its distal end and at its proximal end behind the guard ring.

The last spike along the longitudinal axis of the core starting from the stem may be positioned at a non-zero distance from the distal end of the core, in particular between 1 mm and 1.4 mm.

Packaging and Application Device

A further subject of the invention is a device for packaging and applying a product to the eyelashes and/or eyebrows, having an applicator according to the invention, as defined above, and a container containing the product to be applied.

The gripping member of the applicator may constitute a cap for closing the container.

The container preferably has a wiping member suitable for wiping the stem and the applicator member, having a wiping lip.

The product is preferably a mascara.

DETAILED DESCRIPTION

Figure 2:
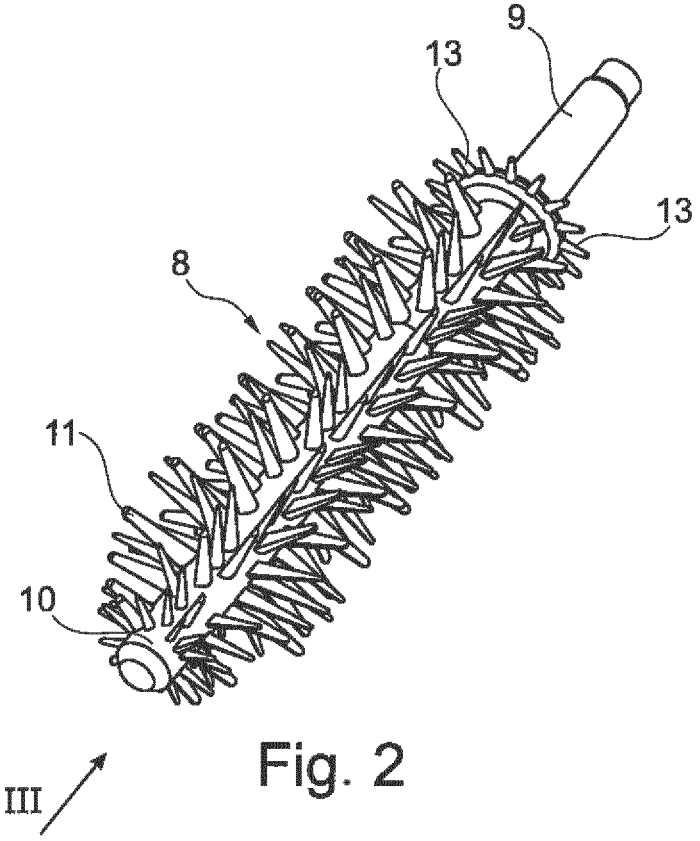
Figure 3:
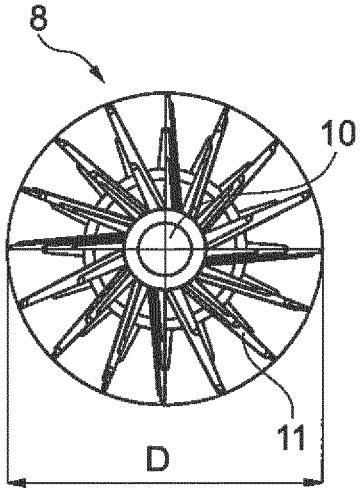
Figure 6:
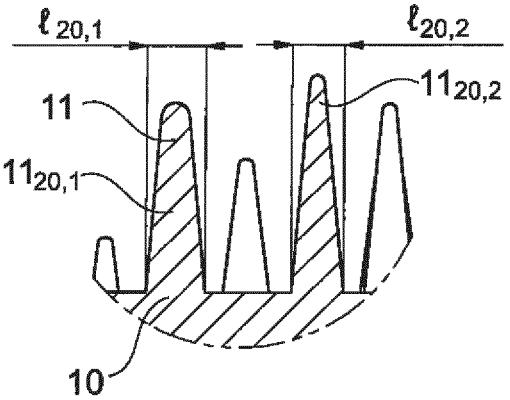
Figure 4:
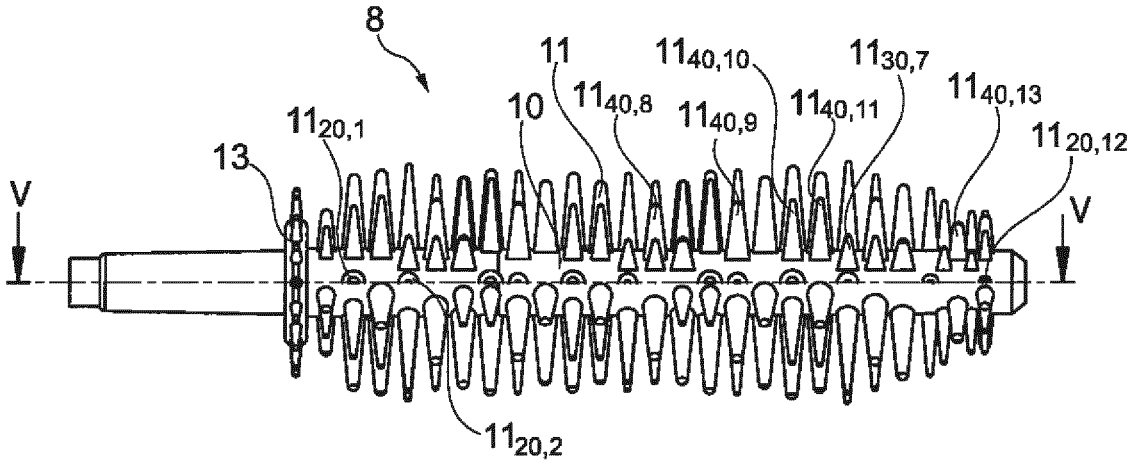
Figure 5:
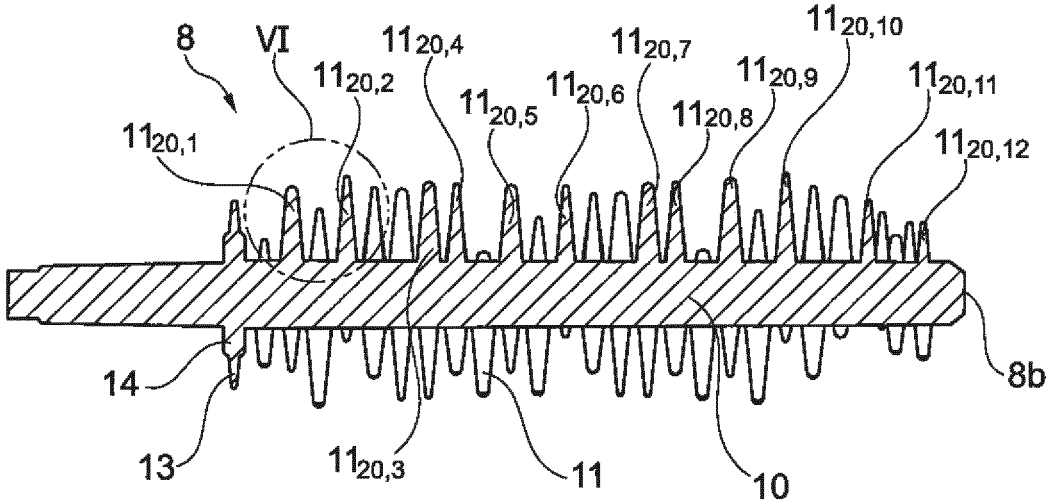
Figure 7:
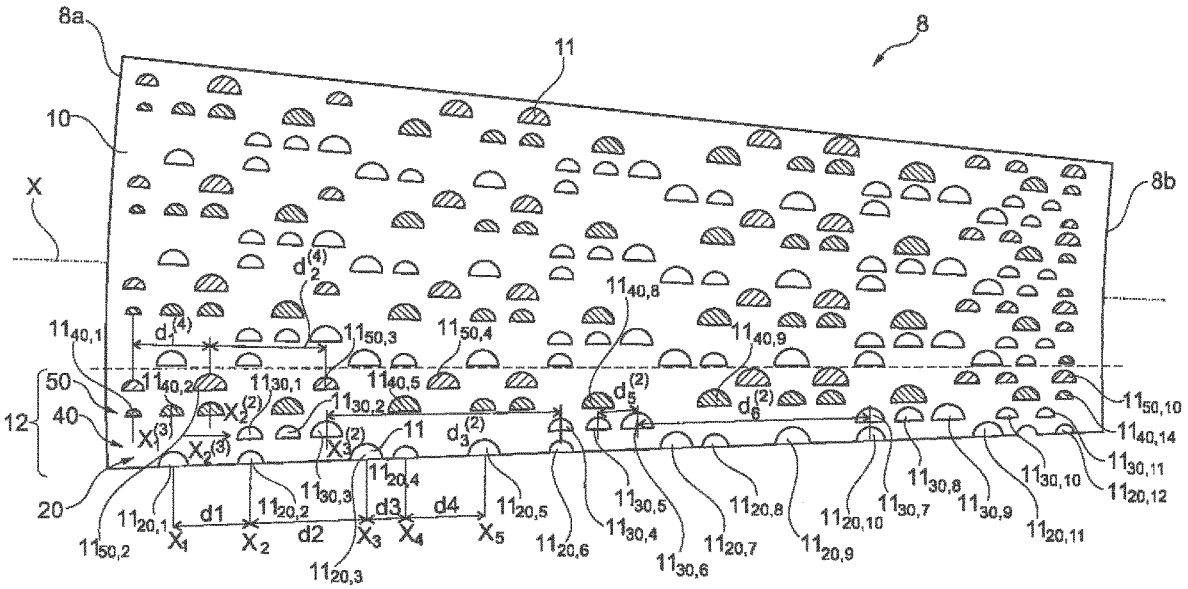

The invention may be better understood from reading the following detailed description of non-limiting implementation examples thereof, and with reference to the appended drawing, in which:

FIG. 1 is a schematic elevation view, in partial longitudinal section, of an example of a packaging and application device produced in accordance with the invention, FIG. 2 shows the brush of the applicator from FIG. 1 on its own, in perspective, FIG. 3 is a front view along III from FIG. 2, FIG. 4 shows a side view of the brush, on its own, FIG. 5 is a longitudinal section through the brush, along V-V from FIG. 4, FIG. 6 shows the detail VI from FIG. 5, and FIG. 7 is a flat developed view of the implantations of the spikes on the core, the guard collar not being represented in this figure.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The latter has a stem 7 of longitudinal axis Y, which is attached at its upper end to the closure cap 5 and at its lower end to a brush 8 forming the applicator member.

The brush 8 has, as illustrated in FIGS. 2 to 7, a core 10 that bears spikes 11 that extend from the core 10 and all around the latter.

The container 3 also has a wiping member 6, inserted into the neck 4.

This wiping member 6, which may be of any suitable type, has, in the example in question, a lip designed to wipe the stem 7 and the brush 8 when the applicator 2 is withdrawn from the container 3. The lip defines a wiping orifice having a diameter adapted to that of the stem 7. The wiping member 6 may be made of elastomer. The wiping orifice has for example a circular shape.

The diameter of the wiping orifice is typically between 3 and 5.5 mm, and is for example around 4.5 mm or 5 mm.

In the example illustrated, the stem 7 has a circular cross section, but, if the stem 7 has some other cross section, this does not depart from the scope of the present invention, it then being possible to fix the cap 5 on the container 3 in some other way than by screwing, if necessary. The wiping member 6 is adapted to the shape of the stem 7 and to that of the brush 8, if appropriate.

Preferably, and as in the example in question, the longitudinal axis Y of the stem 7 is rectilinear and coincident with the longitudinal axis of the container 3 when the applicator 2 is in place thereon, but, if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

As illustrated in particular in FIG. 2, the brush 8 preferably has an end piece 9 for fixing it in a corresponding housing in the stem 7.

The brush 8 may be fixed in this housing in the stem 7 by any means, and notably by force-fitting, snap-fastening, adhesive bonding, welding, stapling or crimping.

With reference to FIG. 2, it can be seen that the core 10 has a shape that is elongate along a longitudinal axis X, which is rectilinear in the example described. The longitudinal axis X may be central, as illustrated.

The visible length H of the brush 8 is for example equal to around 27 mm.

If reference is made to FIG. 7, it is seen that the spikes 11 are positioned on the core 10 along longitudinal rows.

More particularly, in the example considered, these rows may be broken down into four groups 12 of four rows each which are repeated around the longitudinal axis X. Each group 12 thus substantially occupies an angular sector of 90 degrees around the longitudinal axis of the core 10.

The patterns formed by the spikes of the rows of one group 12 are thus repeated angularly several times around the longitudinal axis of the core.

In the example considered, a group 12 comprises a first row 20 of spikes 11 and three other adjacent rows 30, 40 to 50 of spikes, all the rows of one group 12 each extending along a specific longitudinal axis which is rectilinear and contained in a plane containing the longitudinal axis X of the core 10.

The core has a general frustoconical shape converging in the direction of the distal end 8*b* of the brush 8, so that each longitudinal axis along which a row 20, 30, 40 or 50 extends forms a generatrix of the surface of the core 10.

However, the invention is not limited to one particular cross-sectional shape of the core 10, as mentioned above.

The row 20 comprises a series of 12 spikes $\mathbf{11}_{20.1}$ to $\mathbf{11}_{20.12}$, of which the first five spikes $\mathbf{11}_{20.1}$ to $\mathbf{11}_{20.5}$ starting from the proximal end 8*a* have respective abscissae $x_1$ to $x_5$.

The abscissa of a given spike is measured in a mid-plane of this spike, perpendicular to the specific longitudinal axis of the corresponding row, as illustrated in FIG. 7. The expression $d_i=x_{i+1}\times x_i$ denotes the distance between the spikes of abscissae $x_{i+1}$ and $x_i$.

In accordance with one aspect of the invention, the abscissae $x_1$ to $x_4$ have no arithmetic or geometric progression, that is to say that the distances $d_i$ and $d_j$ are different in pairs for any different whole i, j values between 1 and 3, and $d_3/d_2$ is different from $d_2/d_1$.

In the example considered, $d_4/d_3$ is different from $d_3/d_2$ and $d_4/d_3$ is different from $d_2/d_1$ also.

In the example considered, at least two spikes of the series of spikes $\mathbf{11}_{20.1}$ to $\mathbf{11}_{20.12}$ are of different size.

For example, there are cross sections measured at the base of the spikes, at the attachment to the core, which are different. The spike $\mathbf{11}_{20.1}$ has a larger cross section at its base than that of the spike $\mathbf{11}_{20.2}$ and the spike $\mathbf{11}_{20.3}$ has a larger cross section at its base than that of the spike $\mathbf{11}_{20.2}$.

It is also possible to have, as illustrated, the spike $\mathbf{11}_{20.4}$ which has a smaller cross section at its base than that of the spike $\mathbf{11}_{20.3}$ and more generally an alternation, on going from the proximal end of the core to the distal end thereof, of a spike of larger cross section at its base with a spike of smaller cross section at its base within the first row 20. The second to last spike $\mathbf{11}_{20.11}$ has substantially the same cross section at its base as the adjacent spike which precedes it $\mathbf{11}_{20.10}$. The last spike $\mathbf{11}_{20.12}$ of the row 20 has a smaller cross section at its base. The radius of curvature at the free end of the spikes of larger cross section at their base may be greater than that of the spikes of smaller cross section, as can be seen in FIG. 6.

The spikes of larger cross section at their base may have a height different to that of the spikes of smaller cross section at their base.

The width $l_{20.1}$ of the first spike $\mathbf{11}_{20.1}$ of larger cross section at its base, as illustrated in FIG. 6, may be between 0.8 mm and 0.9 mm. In this figure, the adjacent spike $\mathbf{11}_{20.2}$, which is slightly higher and has a smaller radius of curvature at its end, has a width $l_{20.2}$ of between 0.7 mm and 0.8 mm at its base.

The first row 20 may comprise within it a series of spikes having substantially the same height, even though some of them have different cross sections at their base.

In the example considered, the spikes $\mathbf{11}_{20.3}$ to $\mathbf{11}_{20.7}$ are thus substantially of the same height, as can be seen in FIG. 5. There is for example, for the height of the spikes of the first row, a growth in height from the first spike to the second, then a decrease to the third, a substantially constant height through to the seventh, a growth through to the tenth, and finally a decrease through to the twelfth.

The second row 30 comprises spikes $\mathbf{11}_{30.1}$ to $\mathbf{11}_{30.11}$ of lower height than those of the first row, as can be seen in FIG. 4.

The first nine spikes of this second row 30 are grouped together in threes.

If $x_1^{(2)}$, $x_2^{(2)}$, $x_3^{(2)}$ denote the respective abscissae of the first three spikes of the second row 30, thus a distance for $dj^{(2)}=x_{j+1}^{(2)}-x_j^{(2)}$.

Thus also $d_1^{(2)}=d_2^{(2)}=d_4^{(2)}=d_5^{(2)}=d_7^{(2)}=d_8^{(2)}$, and $d_3^{(2)}=d_6^{(2)}$, with $d_3^{(2)}>d_1^{(2)}$. Thus for example, as illustrated, $d_3^{(2)}=d_6^{(2)}$, approximately equal to $6*d_1^{(2)}$.

The first two spikes of each group of three, for the second row 30, are identical, and have a smaller cross section at their base than that of the third spike.

The last two spikes of the second row 30 have a smaller cross section at their base than all the other spikes of this row.

The abscissa of the first spike of the second row is substantially equal to that of the second spike of the first row. The abscissa of the fourth spike of the second row is substantially equal to that of the sixth spike of the first row. The abscissa of the seventh spike of the second row is substantially equal to that of the tenth spike of the first row.

The third row 40 comprises more spikes than the first row and than the second row, namely 14 spikes $\mathbf{11}_{40.1}$ to $\mathbf{11}_{40.14}$ in the example considered.

The cross section at the base of the first four spikes $\mathbf{11}_{40.1}$ to $\mathbf{11}_{40.4}$ increases, then remains substantially constant for the next spike, before decreasing for the sixth spike. The cross section at the base of this sixth spike is approximately equal to that of the second spike. The cross section at the base of the seventh spike is equal to that of the sixth spike, then the cross section at the base of the spikes increases again with the eighth spike, which has substantially the same cross section at its base as the fourth and fifth spikes. The ninth and twelfth spikes have substantially the same cross section as the eighth, and the tenth, eleventh and thirteenth have substantially the same cross section at their base as the third.

The spikes of the third row having the same cross section at their base may have the same height, as can be seen in FIG. 4.

The abscissa $x_2^{(3)}$ of the second spike of the third row may be substantially equal to the abscissa $x_1$ of the first spike of the first row.

The abscissa of the fourth spike of the third row may be substantially equal to that of the second spike of the second row. The abscissa of the fifth spike of the third row may be substantially equal to that of the fourth spike of the first row. The abscissa of the sixth spike of the third row may be substantially equal to that of the fifth spike of the first row. The abscissa of the ninth spike of the third row may be substantially equal to that of the eighth spike of the first row. The abscissa of the twelfth spike of the third row may be substantially equal to that of the eighth spike of the second row. The abscissa of the fourteenth spike of the third row may be substantially equal to that of the last spike of the first row.

The fourth row 50 comprises 10 spikes $\mathbf{11}_{50.1}$ to $\mathbf{11}_{50.10}$.

The cross section at their base of the spikes of the fourth row increases between the first and second spikes, then decreases with the third spike, before increasing with the fourth. The fifth spike of the fourth row has the same cross section at its base as the fourth. The cross section of the spikes at their base increases slightly between the fifth and the sixth spikes reaching a maximum for the sixth and seventh spikes. The eighth spike has a significantly smaller cross section, substantially equal to that of the first spike. The ninth spike has a cross section at its base that is slightly smaller than that of the preceding one, and the last spike has the same cross section at its base as the eighth.

The first spike of the fourth row has the same abscissa as the first spike of the first row. The second spike of the fourth row has the same abscissa as the third spike of the third row. The third spike of the fourth row has the same abscissa as the third spike of the second row. The seventh spike of the fourth row has the same abscissa as the eleventh spike of the third row. The last spike of the fourth row has the same abscissa as the last spike of the first and third rows.

Thus, $d_1^{(4)}<d_2^{(4)}$ and $d_2^{(4)}=d_3^{(4)}$, $d_4^{(4)}<d_3^{(4)}$, $d_4^{(4)}=d_1^{(4)}$ and $d_5^{(4)}$ is approximately equal to 3 times $d_4^{(4)}$, $d_6^{(4)}=d_4^{(4)}$, $d_7^{(4)}>d_6^{(4)}$, $d_8^{(4)}<d_7^{(4)}$ and $d_9^{(4)}>d_8^{(4)}$.

If reference is made to FIGS. 4 and 5, it is seen that the brush 8 comprises a guard ring comprising radial spikes 13 evenly distributed angularly around the axis X, and that are attached at their base to a collar 14 having a greater width than the spikes 13.

The diameter of the circle defined by the free ends of the spikes 13 is smaller than the largest diameter of the envelope surface defined by the rows of spikes 11 but larger than that of the circle defined by the first spikes 11. The height of the collar 14 is approximately equal to that of the spikes 13.

The largest diameter D of the envelope surface is for example between 8.8 mm and 9 mm.

In order to mold the brush 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible notably to use the materials known under the trade names Teflon®, Hytrel®, Cariflex®, Alixine®, Santoprene®, Pebax® and Pollobas®, this list not being limiting.

In order to use the device 1, the user unscrews the closure cap 5 and withdraws the brush 8 from the container 3.

Once the brush 8 has passed through the wiping member 6, a particular quantity of product P remains between the spikes 11, creating reservoirs of product P along the entire length of the core 10 and on all sides, making it possible to load the eyelashes and/or eyebrows with product P in a satisfactory manner.

Of course, the invention is not limited to the exemplary embodiment just described.

The applicator 8 may be able to vibrate, that is to say that it is possible to apply vibrations thereto during application, combing or picking up of the product P, for example as described in application WO 2006/090343.

In a further variant, the applicator 8 may be able to rotate, that is to say that the brush 8 may be made to carry out a rotational movement about the longitudinal axis X of the core 10, for example during application, combing or picking up of the product P.

In a further variant, the applicator may be heated, that is to say have a heating element for heating the keratin fibers, the eyelashes and/or eyebrows, in particular by heating the spikes and/or the core 10 of the brush 8.

It is also possible for the applicator to be able to vibrate, to be able to rotate and to be heated, or only to be able to vibrate and to rotate, or only to be able to vibrate and to be heated, or only to be able to rotate and to be heated, or only to be able to vibrate or only to be able to rotate or only to be heated.

The brush 8 may comprise any bactericidal agent such as silver salts, copper salts, preservatives and at least one preservative for the product P.

The core and/or the spikes may, furthermore, comprise particles, for example a filler, in particular a compound which is magnetic, bacteriostatic or absorbs moisture, or else a compound intended to produce roughness on the surface of the spikes or to help the eyelashes and/or eyebrows to slide on the spikes. At least one of the core and a spike may be flocked or undergo any heat treatment or mechanical treatment.

Other arrangements of spikes may be produced.

The spikes may be other than straight spikes of semi-circular cross section.

The invention claimed is:

1. A brush for applying a cosmetic product to the eyelashes and/or eyebrows, comprising:

a core of plastic material, having a longitudinal axis, wherein spikes are carried by the core, extending from the core, and attached to the core, wherein the spikes are arranged at least in a first row of spikes extending longitudinally and including a series of at least four consecutive spikes positioned on the core at respective abscissae $x_1$ to $x_4$ along the longitudinal axis of the core, with distances $d_i=X_{i+1}-X_i$ between the spikes of abscissae $x_{i+1}$ and $x_i$, i being an integer comprised between 1 and 3, being different in pairs, and wherein the core carries at least a group of four rows, composed of said first row and of other rows, which are repeated several times angularly over the core, each row of said group comprises spikes of unequal sizes and spikes of unequal heights, each of said other rows includes a series of at least four consecutive spikes positioned on the core at respective abscissae $x_1$ to $x_4$ along the longitudinal axis of the core, with distances $d_i=x_{i+1}-x_i$ between the spikes of abscissae $x_{i=1}$ and $x_i$, i being an integer comprised between 1 and 3, being different in pairs.

2. The brush as claimed in claim 1, said series of spikes comprising at least a fifth spike of abscissa $x_5$, with a distance between the fourth and fifth spikes, $d_{4=}x_5-x_4$ being different from said distances $d_1$, $d_2$ and $d_3$.

3. The brush as claimed in claim 1, with said distances $d_1$, $d_2$ and $d_3$ not being bound by a proportionality relationship.

4. The brush as claimed in claim 1, with said distances $d_1<d_2$ and $d_3<d_1$.

5. The brush as claimed in claim 1, the pattern formed by said series of spikes being repeated at least once along first row.

6. The brush as claimed in claim 1, said series of spikes comprising at least three spikes of unequal sizes.

7. The brush as claimed in claim 1, comprising at least one other row of spikes adjacent to the first row, these rows being angularly consecutive around the longitudinal axis of the core, these consecutive rows comprising respective series of spikes that form patterns which are different in pairs.

8. The brush as claimed in claim 1, comprising a second row of spikes adjacent to the first, this second row comprising series of at least two spikes grouped together.

9. The brush as claimed in claim 7, at least one of the other row(s), comprising at least one series of at least four consecutive spikes positioned at respective abscissae $x_1^{(j)}$ to $x_4^{(j)}$ along the longitudinal axis, with j the number of the row, and distances $d_i^{(j)}=xi_{+1}^{(j)}-x_i^{(j)}$, between the spikes of abscissae $x_{i+1}$ and $x_i$ of row number j, i being an integer comprised between 1 and 3, being different in pairs.

10. The brush as claimed in claim 7, each of said rows comprising a series of spikes of unequal sizes.

11. The brush as claimed in claim 7, the pattern formed by the first row being repeated around the longitudinal axis of the core.

12. The brush as claimed in claim 7, said other rows each comprising at least one spike having the same abscissa, along the longitudinal axis of the core, as a spike of the first row.

13. The brush as claimed in claim 1, each row comprising between eight and twenty spikes.

14. The brush as claimed in claim 1, the first row comprising a series of spikes of the same height.

15. The brush as claimed in claim 1, comprising a second row of spikes having a lower height than the spikes of the first row.

16. The brush as claimed in claim 1, comprising at least a second row having at least three spikes with constant spacing between them.

17. The brush as claimed in claim 1, comprising a guard ring, comprising radial spikes.

18. A packaging and application device, comprising:

a container containing the product to be applied, a brush as claimed in claim 1.

19. The brush as claimed in claim 2, wherein said distance $d_4$ between the fourth and fifth spikes is greater than the distance $d_3$ between the second and third spikes.

20. The brush as claimed in claim 2, wherein said distances $d_1$, $d_2$, $d_3$ and $d_4$ are not bound by a proportionality relationship.

21. The brush as claimed in claim 1, wherein said spikes of unequal sizes are of unequal heights and/or of unequal cross sections at their base.

22. The brush as claimed in claim 6, wherein said at least three spikes of unequal sizes are of unequal heights and/or of unequal cross sections at their base.

23. The brush as claimed in claim 7, comprising at least two other rows, these rows being angularly consecutive around the longitudinal axis of the core, these consecutive rows comprising respective series of spikes that form patterns which are different in pairs.

24. The brush as claimed in claim 7, comprising at least three other rows, these rows being angularly consecutive around the longitudinal axis of the core, these consecutive rows comprising respective series of spikes that form patterns which are different in pairs.

25. The brush as claimed in claim 8, wherein said second row comprises a series of at least three spikes grouped together.

26. The brush as claimed in claim 9, wherein each of said other rows, comprising at least one series of at least four consecutive spikes positioned at respective abscissae $x_1^{(j)}$ to $x_4^{(j)}$ along the longitudinal axis, with j the number of the row, and distances $d_i^{(j)}=x_{i+1}^{(j)}-x_i^{(j)}$, between the spikes of abscissae $x_{i+1}$ and $x_i$ of row number j, i being an integer comprised between 1 and 3, being different in pairs.

27. The brush as claimed in claim 11, wherein the pattern formed by said other rows is repeated around the longitudinal axis of the core.

28. The brush as claimed in claim 11, wherein the pattern formed by the first row is repeated around the longitudinal axis of the core between three and six times.

29. The brush as claimed in claim 28, wherein the pattern formed by the first row is repeated four times around the longitudinal axis of the core.

30. The brush as claimed in claim 16, comprising at least a third row having at least three spikes with constant spacing between them.

31. The brush as claimed in claim 17, wherein the guard ring is supported by a collar.

* * * * *